US006857671B2

(12) United States Patent
Fly

(10) Patent No.: US 6,857,671 B2
(45) Date of Patent: Feb. 22, 2005

(54) LOCKING DEVICE FOR A DOOR

(75) Inventor: Derek Fly, Kempton Park (ZA)

(73) Assignee: Paul Stefanus Millard (ZA); part interest ( * ) Notice: Subject to any disclaimer, the term of this patent is extended or adjusted under 35 U.S.C. 154(b) by 0 days.

(21) Appl. No.: 10/312,810

(22) PCT Filed: Jun. 28, 2001

(86) PCT No.: PCT/IB01/01148

§ 371 (c)(1),
(2), (4) Date: May 6, 2003

(87) PCT Pub. No.: WO02/01029

PCT Pub. Date: Jan. 3, 2002

(65) Prior Publication Data

US 2003/0164614 A1 Sep. 4, 2003

(30) Foreign Application Priority Data

Jun. 29, 2000 (ZA) ..... 2000/3268

(51) Int. Cl.[7] ..... E05C 17/56
(52) U.S. Cl. ..... 292/251.5; 292/341.16
(58) Field of Search ..... 292/251.5, 341.16; 24/303

(56) References Cited

U.S. PATENT DOCUMENTS 2,435,729 A * 2/1948 Whann et al. ..... 119/426
3,201,960 A * 8/1965 Berkowitz ..... 70/150
3,736,779 A * 6/1973 Pratt ..... 70/276
5,184,855 A * 2/1993 Waltz et al. ..... 292/251.5
5,641,187 A 6/1997 Frolov
6,092,846 A * 7/2000 Fuss et al. ..... 292/302
6,260,892 B1 * 7/2001 Chang ..... 292/251.5
2004/0026933 A1 * 2/2004 Smith ..... 292/251.5

FOREIGN PATENT DOCUMENTS

FR 2 722 232 1/1996
GB 2 123 472 2/1984

* cited by examiner

*Primary Examiner*—Gary Estremsky
(74) *Attorney, Agent, or Firm*—Kilpatrick Stockton LLP

(57) ABSTRACT

The invention provides for an electromagnetic lock (10) for a door. The lock (10) includes a backing plate (12) which is connectable to a door frame, an electromagnet (14), a housing (30) for the electromagnet, and an armature plate (16) connectable to a door (32) which is displaceable relative to the housing (30) between a closed condition in which it engages the housing and an open condition in which it is spaced from the housing. The lock (10) also includes two locking arms (18) which are movable between an operative position in which they engage the armature plate (16) and the backing plate (12) to capture the armature plate in the closed condition and an inoperative position in which they allow the armature plate to disengage the housing (30).

7 Claims, 3 Drawing Sheets

LOCKING DEVICE FOR A DOOR

CROSS-REFERENCE TO RELATED APPLICATION

This application claims the benefit of International Application No. PCT/IB01/01148 filed Jun. 28, 2001.

BACKGROUND OF THE INVENTION

THIS invention relates to a locking device, and more specifically to an electromagnetic locking device for a door.

Conventional electromagnetic locks for doors generally include an electromagnet which is arranged to lock an armature plate on a door to a backing plate on a door frame when current is supplied to the electromagnet, and to release the armature plate when the current is interrupted.

The "breaking strength" of these locks, i.e. the force required to overcome the magnetic attraction between the door and the frame so as to cause the door to open, is proportional to the size of the electromagnet. Accordingly, for high security applications it is often necessary to have a large lock or multiple locks which tend to be bulky an often unattractive and which are relatively high in energy consumption.

It is an object of the present invention to provide an electromagnetic lock for a door which has a relatively high breaking strength in relation to the size of the lock and the magnitude of the current drawn by the electromagnet.

SUMMARY OF THE INVENTION

According to the invention there is provided a locking device for a door comprising:

- a backing plate which is connectable to a door or a door frame;
- an electromagnet;
- a housing for the electromagnet, the housing being movable away from the backing plate between a first position and a second position, and towards the backing plate between the second position and the first position;
- biasing means for biasing the housing into the first position;
- an armature plate which is displaceable relative to the housing between a closed condition in which it engages the housing and an open condition in which it is spaced from the housing; and
- mechanical locking means in the form of at least one locking arm which is movable between an operative position in which it engages the armature plate and the backing plate to capture the armature plate in the closed condition and an inoperative position in which it allows the armature plate to disengage the housing, the at least one locking arm including a formation which is engageable with a corresponding formation on the backing plate so that as the housing is displaced from the first position to the second position the locking arm is displaced from the inoperative position to the operative position.

In a preferred embodiment of the invention, the mechanical locking means comprises a pair of locking arms and biasing means for biasing the locking arms into the inoperative position.

The locking arm biasing means may comprise spring plungers connected to the backing plate.

In a particularly preferred arrangement, each locking arm is pivotally connected to the housing and defines engagement formations at longitudinal ends thereof for engaging the backing plate and the armature plate.

The housing biasing means may include compression coil springs which engage the housing and ties extending from the backing plate.

Each tie may comprise a bolt, for example an Allen bolt, which is sized to extend through an opening in the housing and to threadably engage the backing plate, and a washer for containing the coil spring within the opening defined in the housing.

Typically, the armature plate is connectable to a door and the backing plate is connectable to a door frame.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figure 1:
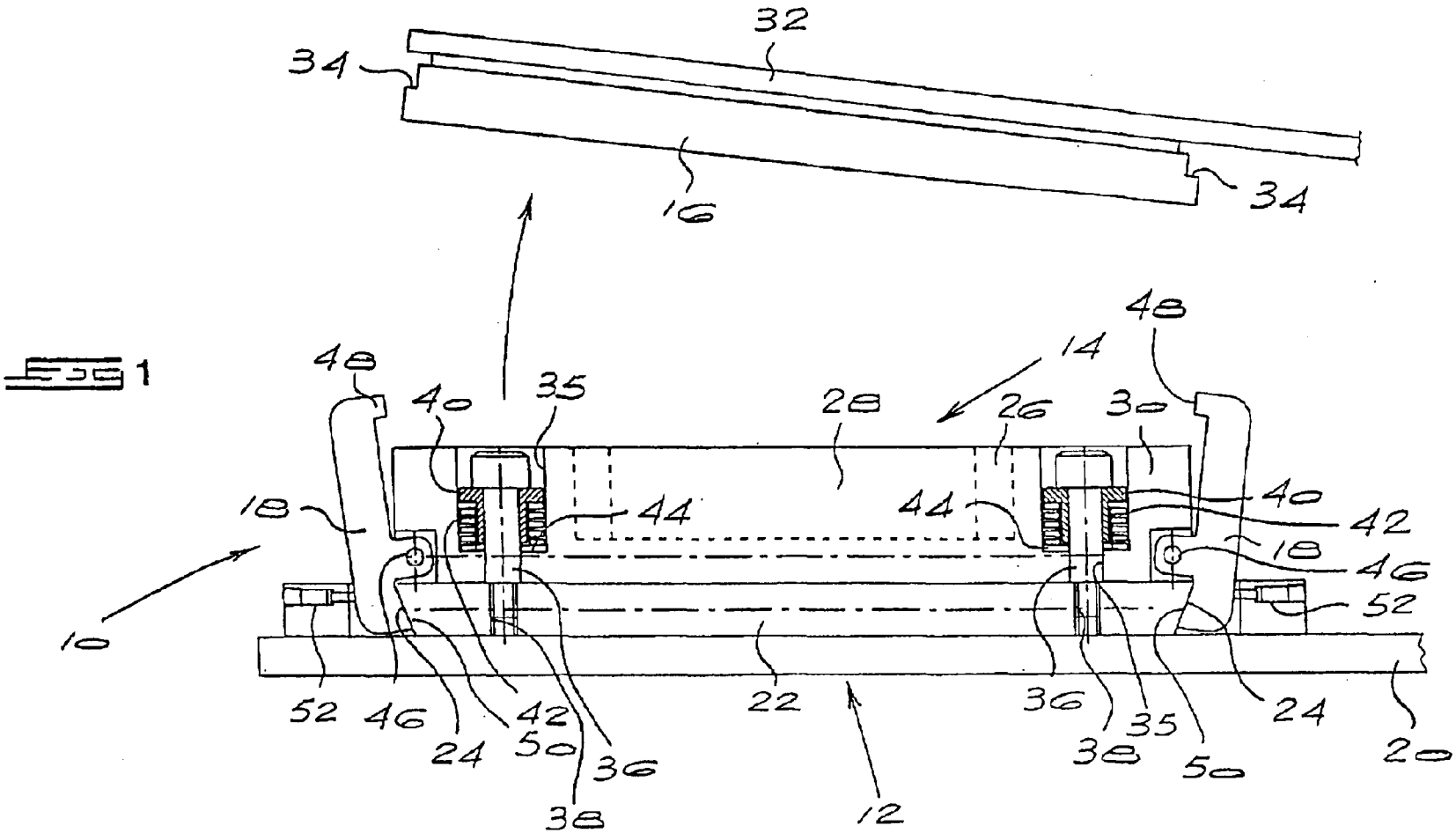
FIG. 1 shows, diagrammatically, a cross-sectional view of a locking device according to the present invention in an open condition.

FIG. 1 of the drawings illustrates a locking device according to the present invention in an open, unlocked condition. The locking device is designated generally with the reference numeral 10 and includes a backing plate 12, an electromagnet 14, a metallic armature plate 16, and mechanical safety catches 18.

The backing plate 12 is seen to include a mounting plate 20 for mounting the backing plate to a door frame (not shown) and an actuator plate 22 for actuating the mechanical safety catches 18. In the illustrated embodiment, the actuator plate is welded to the mounting plate with welds (not shown) and includes inclined surfaces 24 for engaging the safety catches 18 in a manner which is described in more detail below.

The electromagnet 14 includes a coil 26 and a metallic core 28 (illustrated in broken line in FIG. 1), and is mounted in a housing 30, as shown. The unit 14 is electrically connected to the mains power supply via a switch (not illustrated) so as to operate in a conventional manner to generate a magnetic field when current flows through the coil 26. As can be seen in FIG. 1, the armature plate 16 is fixed to a door 32 and carries locking projections 34 for locking this plate mechanically in a closed condition.

The housing 30 is connected to the backing plate 12 so as to be displaceable relative to the backing plate between a first position (illustrated in FIG. 1) in which the housing rests against the actuator plate 22 and a second position in which the housing is spaced from the actuator plate. A pair of openings 35 is provided in the housing 30, as shown, for accommodating a biasing mechanism for biasing this housing against the backing plate. The biasing mechanism comprises a pair of Allen bolts 36 which is designed to pass through the openings 35 and to engage a pair of threaded bores 38 in the actuator plate 22. A washer 40 having a top-hat configuration is provided around the shaft of each Allen bolt 36 for containing a compression coil spring 42 within each opening 35, as illustrated. The springs 42 are seen in FIG. 1 to be contained between the washers 40 and shoulders 44 in the openings 35.

Figure 2:
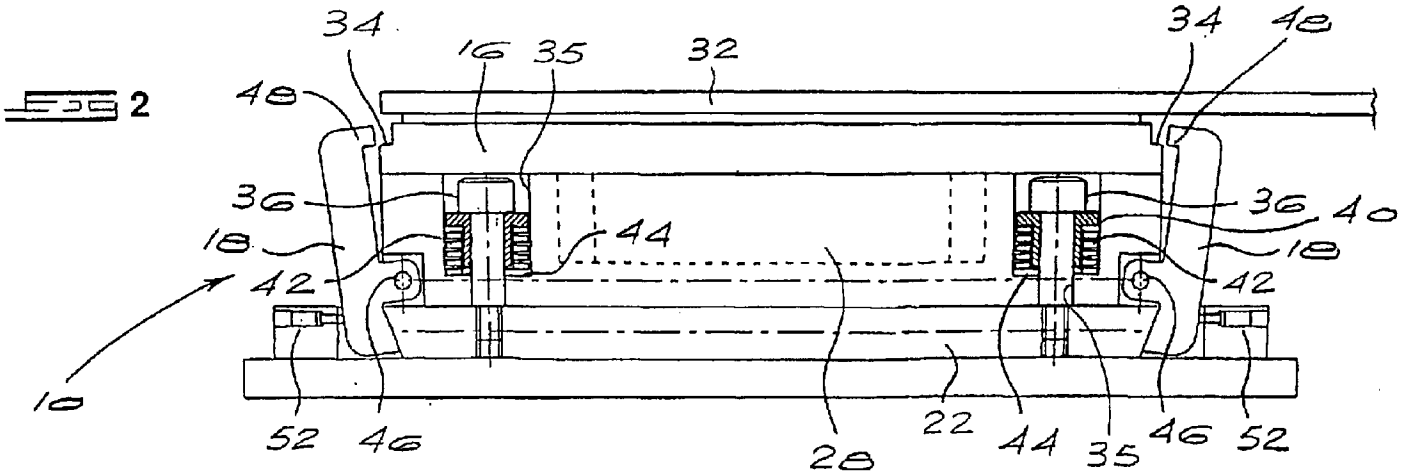
FIG. 2 shows, diagrammatically, a cross-sectional view of the locking device of FIG. 1 in a closed, locked condition, with safety catches inoperative.
Figure 3:
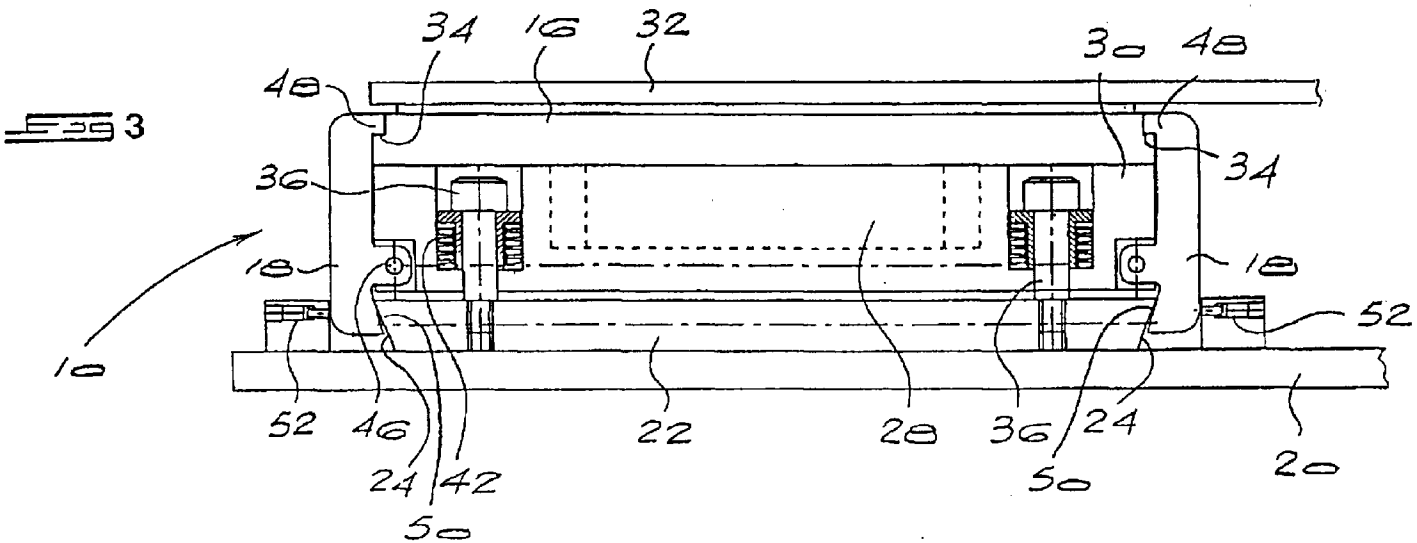
FIG. 3 shows the locking device illustrated in FIG. 2 with the safety catches operative.

With reference also to FIGS. 2 and 3 of the drawings, the safety catches 18 are pivotally connected to the electromagnet housing with pivot pins 46 so as to be pivotable between an inoperative position (as illustrated in FIG. 2) and an operative position (as illustrated in FIG. 3). Each catch includes a formation 48 at one end for engaging one of the locking projections 34 on the armature plate 16, and a formation 50 at the other end for engaging one of the inclined surfaces 24 on the actuator plate 22. A spring plunger 52 is connected to the mounting plate adjacent each catch 18 so as to bias the catch into the inoperative position.

In practice, current is supplied to the electromagnet in a conventional manner so as to generate a magnetic field for attracting the metallic armature plate 16. When the door is closed (see FIG. 2), the armature plate engages the electromagnet housing 30 and is locked to the housing by the magnetic forces. To open the door, an authorised user enters a code into a key pad (not shown). It will be appreciated that instead of a keypad the locking device could include other means for identifying an authorised user, for example a card reader for reading data on a data-carrying card. In the illustrated embodiment, the keypad is electronically linked to a transmitter (also not shown) which, upon entry of the correct code, transmits a signal to the switch. When the switch receives the signal from the transmitter, it opens automatically so as to interrupt the flow of current to the electromagnet, and consequently the magnetic field generated by the electromagnet. When this occurs, the door may be opened (see FIG. 1). Typically, the switch is maintained open for a predetermined interval, afterwhich it automatically closes so as to restore the current flow and the magnetic field.

If an unauthorised user attempts to open the door forceably by pulling the door away from the door frame, the armature plate 16 draws the electromagnet housing 30 away from the backing plate 12 against the bias of the coil springs 42. As the housing is drawn away from the backing plate, the formations 50 on the catches 18 ride along the inclined surfaces 24 on the actuator plate 22 thereby pivoting the catches into the locked, FIG. 3 position. In this Figure, the housing 30 is seen spaced from the actuator plate 22 and the formations 48 on the catches 18 are seen to be interlocked with the locking projections 34 on the armature plate so as to capture the armature plate mechanically. Additional loads applied to the door are then received by the catches 18 which are designed to resist higher loads than the electromagnet. In this way, a relatively high breaking strength can be achieved with a relatively small locking device 10.

When the door is released, the springs 42 bias the housing 30 back against the actuator plate 22, and the spring plungers 52 bias the catches 18 back into the inoperative position illustrated in FIGS. 1 and 2.

The catches 18 simply serve to restrain unauthorised entry by mechanically locking the armature plate 16 to the backing plate 12. In normal use, these catches are biased into, and remain in, the inoperative position so that the door is locked and unlocked by means of the electromagnet only. This ensures that the lock always fails safe when current flow to the electromagnet is interrupted.

Figure 4:
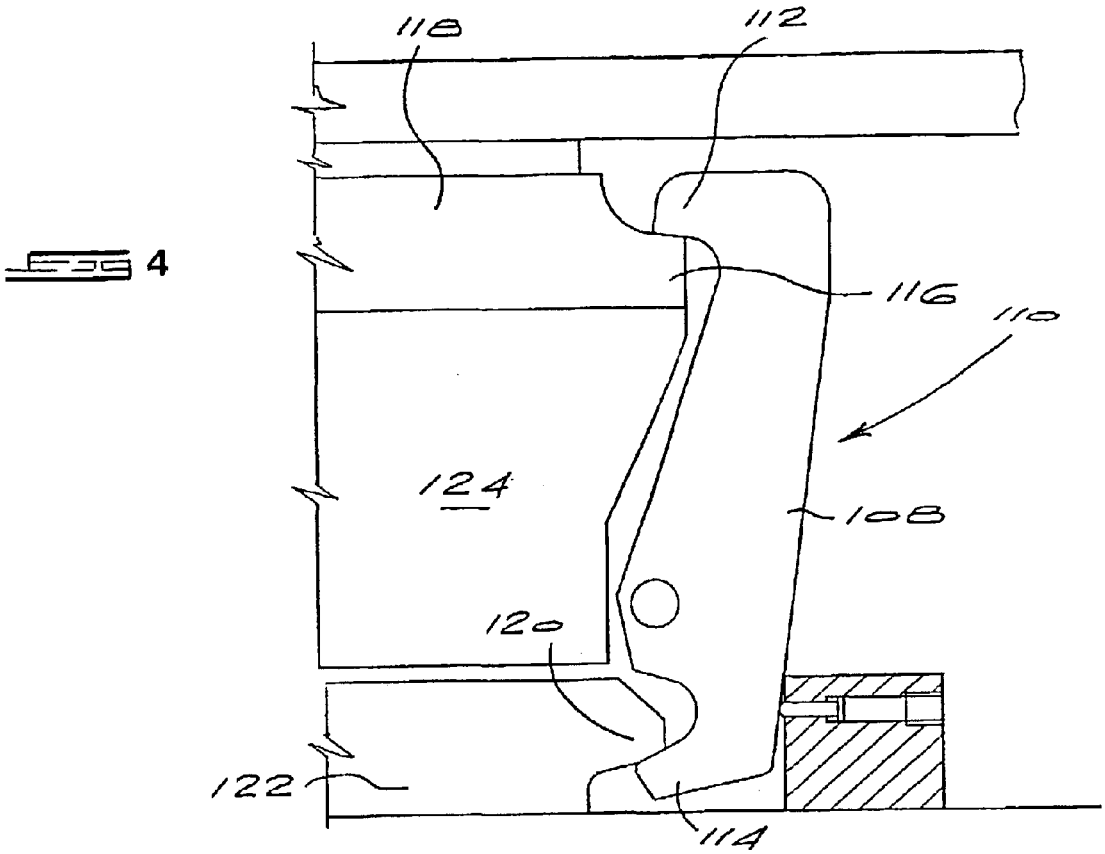
FIGS. 4 and 5 shows cross-sectional views of a portion of a locking device according to another embodiment of the invention with safety catches in an operative position and an inoperative position, respectively.
Figure 5:
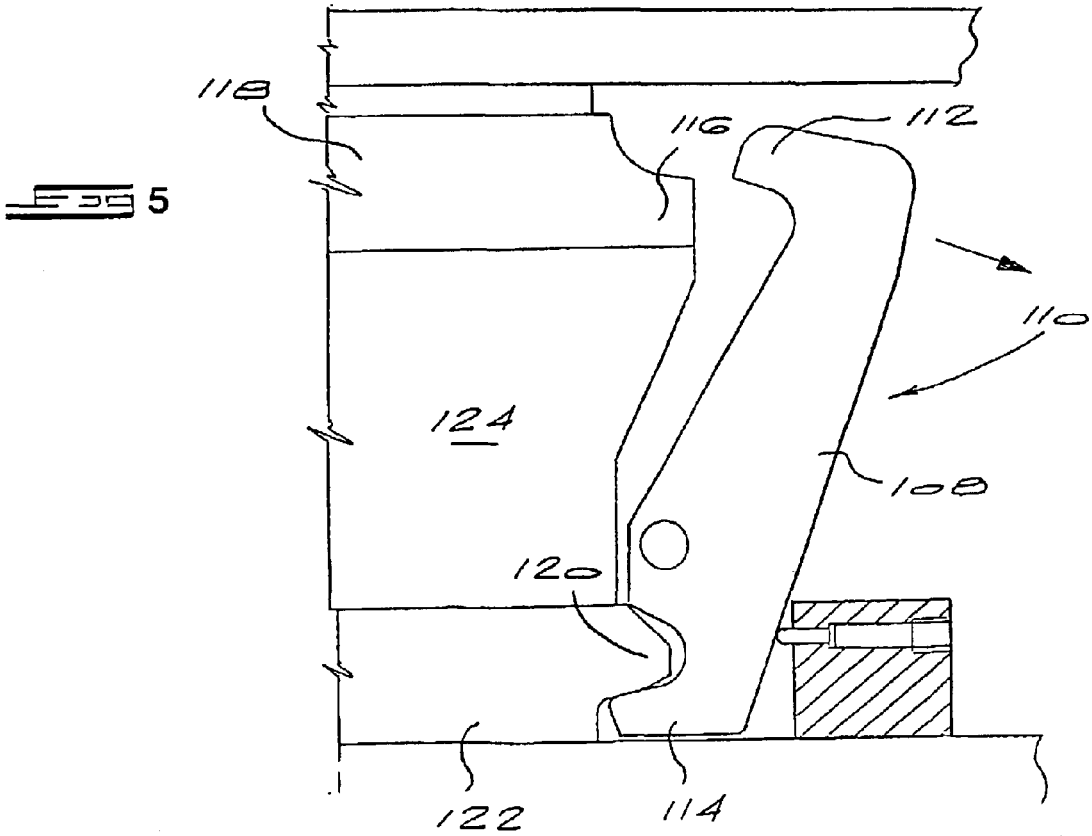

FIGS. 4 and 5 illustrate safety catches 108 on a locking device 110 according to another embodiment of the invention. In this case, the shapes of the locking formations 112 and 114 on the catches 108, the locking formations 116 on the armature plate 118, and the locking formations 120 on the actuator plate 122 differ from those illustrated in FIGS. 1 to 3 of the drawings. Although the catches 108 operate in a similar fashion to the catches 18 described above with reference to the first embodiment, the FIGS. 4 and 5 catches are believed to be more effective and therefore are preferred.

The locking device 110 also includes a sensor (not illustrated), typically in the form of a proximity switch or a microchip, which is designed to sense displacement of an electromagnet housing 124 away from the actuator plate 122, thereby to indicate unauthorised tampering with the lock. In a preferred embodiment of the invention, the sensor is linked electronically to a central control room so that unauthorised tampering with a particular door in a building is evident from the control room.

A major advantage of the locking device according to the invention is that a relatively high resistance to unauthorised entry can be achieved by a locking device with a relatively small electromagnet. This means that, for a given breaking strength, the energy required to operate the locking device is relatively low and the locking device is relatively small. Apart from reducing the cost of the lock, the reduction in size affects the aesthetic appeal of the lock in that it is not necessary to have a large and cumbersome lock, or multiple locks, on the door.

What is claimed is:

1. A locking device for a door comprising:

a backing plate which is connectable to a door or a door frame;

an electromagnet;

a housing for the electromagnet, the housing being movable away from the backing plate between a first position and a second position, and towards the backing plate between the second position and the first position;

biasing means for biasing the housing into the first position;

an armature plate which is displaceable relative to the housing between a closed condition in which it engages the housing and an open condition in which it is spaced from the housing; and mechanical locking means in the form of at least one locking arm which is movable between an operative position in which it engages the armature plate and the backing plate to capture the armature plate in the closed condition and an inoperative position in which it allows the armature plate to disengage the housing, the at least one locking arm including a formation which is engageable with a corresponding formation on the backing plate so that as the housing is displaced from the first position to the second position the locking arm is displaced from the inoperative position to the operative position.

2. A locking device according to claim 1, wherein the mechanical locking means comprises a pair of locking arms and biasing means for biasing the locking arms into the inoperative position.

3. A locking device according to claim 2, wherein the locking arm biasing means comprises spring plungers connected to the backing plate.

4. A locking device according to claim 1, wherein each locking arm is pivotally connected to the housing and defines engagement formations at longitudinal ends thereof for engaging the backing plate and the armature plate.

5. A locking device according to claim 1, wherein the housing biasing means includes compression coil springs which engage the housing and ties extending from the backing plate.

6. A locking device according to claim 5, wherein each tie extending from the backing plate comprises a bolt which is sized to extend through an opening in the housing and which is threadably engageable with the backing plate, and awasher for containing the coil spring within the opening defined by the housing.

7. A locking device according to claim 1, wherein the armature plate is connectable to a door and the backing plate is connectable to a door frame.

* * * * *